US008067354B2

(12) United States Patent
Kubota et al.

(10) Patent No.: US 8,067,354 B2
(45) Date of Patent: Nov. 29, 2011

(54) SOFTENING DETERGENT COMPOSITION

(75) Inventors: Teruo Kubota, Wakayama (JP); Yohei Ozeki, Wakayama (JP); Wataru Ueno, Wakayama (JP); Motomitsu Hasumi, Wakayama (JP)

(73) Assignee: Kao Corporation, Tokyo (JP)

( * ) Notice: Subject to any disclaimer, the term of this patent is extended or adjusted under 35 U.S.C. 154(b) by 193 days.

(21) Appl. No.: 12/086,291

(22) PCT Filed: Dec. 26, 2006

(86) PCT No.: PCT/JP2006/325867

§ 371 (c)(1),
(2), (4) Date: Jun. 10, 2008

(87) PCT Pub. No.: WO2007/077813

PCT Pub. Date: Jul. 12, 2007

(65) Prior Publication Data

US 2009/0170746 A1 Jul. 2, 2009

(30) Foreign Application Priority Data

Dec. 28, 2005 (JP) ..... 2005-380427

(51) Int. Cl.
*C11D 1/83* (2006.01)

(52) U.S. Cl. ..... 510/507

(58) Field of Classification Search ..... 510/507
See application file for complete search history.

(56) References Cited

U.S. PATENT DOCUMENTS

| | | | | |
|---|---|---|---|---|
| 4,062,647 | A | 12/1977 | Storm et al. | |
| 4,822,516 | A | 4/1989 | Suzuki et al. | |
| 5,332,513 | A | 7/1994 | Doms et al. | |
| 5,364,553 | A * | 11/1994 | Cao | 510/321 |
| 5,500,151 | A * | 3/1996 | Cao et al. | 510/321 |
| 5,604,197 | A * | 2/1997 | Busch et al. | 510/516 |
| 6,040,288 | A * | 3/2000 | Popoff et al. | 510/466 |
| 6,436,889 | B1 * | 8/2002 | Sta et al. | 510/298 |
| 6,495,505 | B1 | 12/2002 | Reul et al. | |
| 6,881,717 | B1 | 4/2005 | Hall et al. | |
| 2003/0153473 | A1 | 8/2003 | McRitchie et al. | |
| 2004/0142841 | A1 * | 7/2004 | de Buzzaccarini et al. | 510/296 |
| 2005/0026803 | A1 * | 2/2005 | Sivik et al. | 510/357 |
| 2005/0215457 | A1 * | 9/2005 | Becks et al. | 510/438 |
| 2005/0256024 | A1 * | 11/2005 | Barry et al. | 510/466 |
| 2006/0122089 | A1 * | 6/2006 | Lambotte et al. | 510/295 |
| 2007/0111919 | A1 * | 5/2007 | Boerefijn et al. | 510/445 |
| 2007/0142265 | A1 | 6/2007 | Oki et al. | |

FOREIGN PATENT DOCUMENTS

| | | | |
|---|---|---|---|
| EP | 0 426 876 | A1 | 5/1991 |
| GB | 2 138 037 | A | 10/1984 |
| JP | 49-85102 | A | 8/1974 |
| JP | 63-264699 | A | 11/1988 |
| JP | 3-277696 | A | 12/1991 |
| JP | 5-140869 | A | 6/1993 |
| JP | 8-506843 | A | 7/1996 |
| JP | 10-331067 | A | 12/1998 |
| JP | 2000-256699 | A | 9/2000 |
| JP | 2002-249799 | A | 9/2002 |
| JP | 2002-541342 | A | 12/2002 |
| JP | 2005-511823 | A | 4/2005 |
| JP | 2005-206811 | A | 8/2005 |
| WO | WO-94/19440 | A1 | 9/1994 |

OTHER PUBLICATIONS

Supplementary European Search Report issued on Jan. 27, 2010 in corresponding European patent application No. EP 06 84 3251.
Office Action issued Dec. 28, 2010, in Chinese Patent Application No. 200680047556.X, with English translation.
Office Action issued on Aug. 2, 2011 for corresponding Japanese Application No. 2006-298169 with English Translation.

* cited by examiner

*Primary Examiner* — John Hardee
(74) *Attorney, Agent, or Firm* — Birch, Stewart, Kolasch & Birch, LLP

(57) ABSTRACT

[PROBLEMS] To provide a softening detergent composition capable of washing a fibrous manufactured article having softening ability, and at the same time allowing a clay mineral to be less likely to remain on clothes.

3 Claims, No Drawings

SOFTENING DETERGENT COMPOSITION

TECHNICAL FIELD

The present invention relates to a softening detergent composition in which a clay mineral is used as a softening base agent.

BACKGROUND ART

Conventionally, there has been studied to formulate a softening agent to a detergent for the purpose of preventing the loss of softness to have a stiff feel of the washed fibrous manufactured article due to the detachment of a fiber treating agent, deposition of salts or the like. For example, as a softening agent for giving softness to the feel of the fibrous manufactured article by the deposition of the softening agent on the fiber surface, a clay mineral such as smectite (see, for example, Patent Publication 1); a cationic surfactant such as a dialkylated quaternary ammonium salt (see, for example, Non-Patent Publication 1); a silicone such as poly(dimethyl siloxane) (see, for example, Patent Publication 2); and the like have conventionally been known to be formulated. Also, in recent years, studies have been made on a method of enhancing softening effects of a clay mineral from the viewpoint of easiness in formulation, environmental issue and the like. For example, there have been known a combined use of bentonite and a pentaerythritol compound (see, for example, Patent Publication 3), a combined use of a clay mineral and an aggregating agent (see, for example, Patent Publication 4), a combined use of bentonite and a soluble potassium salt (see, for example, Patent Publication 5 and Non-Patent Publication 1), and the like. In addition, there has been known that a so-called Ca-bentonite has a high softening ability, as compared to a Na-bentonite.

On the other hand, the trends of recent washing machine, such as lowered temperature of washing water and shortened operating time, in response to environmental and energy issues and economic advantages, all trigger a delay of a rate of dispersing clay granules such as smectite. Concerns that undispersed particles of clay mineral resulting from the delay remain on clothes have been increased.

Also, in recent years, as a part of reinforcement of detergency, especially a detergency against oil stains, a nonionic surfactant has been formulated as a main surfactant. However, as a result of intensive studies, the present inventors have found a disadvantage that if a nonionic surfactant is present in a detergent containing Ca-bentonite granules, dispersibility of clay granules is more likely to be remarkably lowered, and a combination of the formulation of nonionic surfactant and the Ca-bentonite causes the clay granules to remain on clothes, as with the trends of recent washing machine.

Patent Publication 1: JP-A-Showa-49-85102
Patent Publication 2: JP-A-2002-249799
Patent Publication 3: JP-A-Hei-5-140869
Patent Publication 4: JP-A-2002-541342
Patent Publication 5: JP-A-Hei-8-506843
Non-Patent Publication 1: *Shuchi Kanyo Gijutsu Shu* (Laundry Powder Detergent), published on Mar. 26, 1998

DISCLOSURE OF INVENTION

Problems to be Solved by the Invention

An object of the present invention is to provide a softening detergent composition capable of washing a fibrous manufactured article or the like having softening ability, and at the same time allowing a clay mineral to be less likely to remain on clothes by using the softening detergent composition.

Means to Solve the Problems

Specifically, the gist of the present invention relates to: a softening detergent composition containing:

(a) 1 to 20% by mass of clay granules containing as a main component a smectite clay mineral represented by the following general formula (I), provided that a Na/Ca mass ratio in the granules is less than 1.0:

$$[Si_8(Mg_aAl_b)O_{20}(OH)_4]^{X-}.X/n\ [Me]^{n+} \quad (I)$$

wherein a, b, and x satisfy the formulas $0<a\leqq 6$, $0\leqq b\leqq 4$, $0.2\leqq x=12-2a-3b\leqq 1.2$; Me is at least one member of Na, K, Li, Ca, Mg and $NH_4$; and n is valency of Me;

(b) 1.0 to 18% by mass of a nonionic surfactant;

(c) 6 to 27% by mass of an anionic surfactant, provided that a salt of a fatty acid is excluded;

(d) 10 to 35% by mass of an alkalizing agent, provided that a silicate is contained in an amount of 6% by mass or less of the softening detergent composition; and (e) 3 to 35% by mass of a crystalline aluminosilicate, and further satisfying at least one of the following conditions (i) to (ii):

(i) Na is contained in an amount of 1.0% by mass or more of the clay granules; and (ii) a water-soluble Na salt and/or a water-soluble K salt is contained in an amount corresponding to 23% by mass or more of the softening detergent composition when calculated as $Na_2O$ or $K_2O$ (in a total amount of 23% by mass or more when both a water-soluble Na salt and a water-soluble K salt are contained).

Effects of the Invention

By using the softening detergent composition of the present invention, there are exhibited some effects that a fibrous manufactured article or the like having softening ability can be washed, and that a clay mineral is less likely to remain on clothes.

BEST MODE FOR CARRYING OUT THE INVENTION

1. Softening Detergent Composition

The softening detergent composition of the present invention will be described more specifically hereinbelow.

<Component (a)>

The component (a) of the softening detergent composition of the present invention is clay granules containing a smectite clay mineral represented by the following general formula (I) as a main component (in the present application, the main component refers to those contained in an amount of 50% by mass or more in the granules), provided that a Na/Ca mass ratio in the granules is less than 1.0:

$$[Si_8(Mg_aAl_b)O_{20}(OH)_4]^{X-}.X/n\ [Me]^{n+} \quad (I)$$

wherein a, b, and x satisfy the formulas $0<a\leqq 6$, $0\leqq b\leqq 4$, $0.2\leqq x=12-2a-3b\leqq 1.2$, and preferably $0<a<6$, $0<b<4$, $0.2\leqq x=12-2a-3b\leqq 1.2$; Me is at least one member of Na, K, Li, Ca, Mg and $NH_4$; and n is valency of Me.

The component (a) is contained in an amount of from 1 to 20% by mass, preferably from 2 to 20% by mass, more preferably from 4 to 18% by mass, even more preferably from 6 to 16% by mass, even further more preferably from 8 to 15% by mass, and especially preferably from 10 to 14% by mass, of the softening detergent composition, from the viewpoint of softening ability and detergency.

Since a clay mineral, especially a natural product, contains impurities such as quartz, cristobalite, calcite, feldspar, talc, and dolomite, the amount of the component (a) contained refers to those including these impurities. In addition, components such as water, a binder, and an additive, used during the granulation are also included in the amount of the component (a) contained. Therefore, in the clay granules which are the component (a), the phrase "a smectite clay mineral represented by the general formula (I) is contained as a main component" means that the above smectite clay mineral is contained in an amount of 50% by mass or more, and preferably from 60 to 90% by mass or more, of the granules.

Incidentally, an another embodiment of the present invention includes those in which quartz, cristobalite, calcite, feldspar, talc, dolomite, and water, which are present as ordinary impurities for the clay mineral represented by (I), and the clay mineral represented by the formula (I) are contained in a total amount of preferably 90% by mass or more, and more preferably 92% by mass or more, of the clay granules.

One of the features of the softening detergent composition of the present invention resides in that the amounts of Na and K which are present in the softening detergent composition are increased, from the viewpoint of improving dispersibility and property of generating insoluble remnants on clothes, of the clay granules. In other words, (i) the amount of Na which is present in the clay granules is preferably from 1.0% by mass or more, and on the other hand, (ii) it is preferable that, as the amounts of Na and K which are present in the softening detergent composition, a water-soluble Na salt and/or a water-soluble K salt is contained in an amount corresponding to 23% by mass (when calculated as $Na_2O$ or $K_2O$) or more (in a total amount of 23% by mass or more when both a water-soluble Na salt and a water-soluble K salt are contained). In the present invention, at least one of the above-mentioned conditions (i) and (ii) is satisfied, and preferably both conditions are satisfied.

The phrase "Na is contained in an amount of 1.0% by mass or more of the clay granules" refers to clay granules in which the amount of Na determined in accordance with the following method is 1.0% by mass or more, and a source of Na includes those which are preliminary present in an ore, Na salts which can be added in the production steps of the clay granules, and the like. Na is preferably contained in an amount of preferably 1.5% by mass or more, more preferably 2.0% by mass or more, and even more preferably 3.0% by mass or more, of the clay granules, from the viewpoint of dispersibility. It is preferable that Na is contained in an amount less than the amount of Ca in the clay mineral which is a starting material, from the viewpoint of softening ability. The upper limit is not particularly limited, and Na is contained in an amount of preferably 6.0% by mass or less, and more preferably 5.0% by mass or less, from the viewpoint of lowering of suitableness for granulation.

In addition, the clay granules are preferably Ca-bentonite granules, from the viewpoint of improvement in softening ability.

The Ca-bentonite granules refer to, in other embodiments of the present invention, clay granules having a mass ratio of Na ion to Ca ion, i.e., Na/Ca, in the clay granules of 1.0 or more.

Examples of the clay granules containing as a main component the smectite clay mineral represented by the general formula (I) include "Laundrosil PR414," "Laundrosil DG," and "Laundrosil DGA212," manufactured by Süd-Chemie; "Detersoft GIS," "Detersoft GIB," and "Detersoft GISW," manufactured by Laviosa; "Questsoft," "Pure Bentonite," and "Standard Bentonite," manufactured by CSM; and the like. The terms within quotation marks are trade names. These components (a) may be a natural product or a synthetic product.

As a method for obtaining the clay granules containing a clay mineral, having a Na/Ca mass ratio of less than 1.0 and containing a large amount of Na, used in the present invention, if the clay granules are a natural product, their origin may be properly selected. Alternatively, for example, when clay granules are produced, the mass ratio can also be adjusted by using a clay mineral containing a large amount of Ca as a starting material and adding a Na salt or the like thereto. In addition, if the clay granules are a synthetic product, the mass ratio can be arbitrarily adjusted by a known method.

The Na/Ca mass ratio and % by mass of Na in the clay granules are determined by the following method.

A 0.1 g sample prepared by pulverizing clay granules with a mortar and pestle, and allowing the pulverized product to pass through a sieve having a sieve opening of 125 μm was subjected to sulfuric acid-hydrogen peroxide degradation with a microwave wet-type ashing apparatus (automatic). A measuring flask in which the degradation product was placed was filled to the brim to a volume of 50 mL, and determined with an ICP emission analyzing apparatus to quantify the amounts of Na and Ca. The mass ratio is calculated from the found values.

The clay granules have a bulk density of preferably from 500 to 1200 g/L, more preferably from 600 to 1100 g/L, and especially preferably from 700 to 1050 g/L, from the viewpoint of non-classifiable property. Here, the bulk density is determined by the method as defined in JIS K 3362. The clay granules have an average particle size of preferably from 200 to 1000 μm, more preferably from 300 to 900 μm, and especially preferably from 400 to 800 μm, from the viewpoint of low-dust generating property and non-classifiable property. Here, the average particle size can be obtained from the weight percentages according to the sizes of each of the standard sieves of JIS K 8801 after vibrating the sieves for five minutes.

In addition, clay granules having a particle size of from 180 to 1410 μm are contained in an amount of preferably 90% by mass or more, and more preferably 95% by mass or more, of the entire clay granules, from the viewpoint of dust generating property and appearance are preferable.

The clay granules have a water content of preferably 18% by mass or less, more preferably 16% by mass or less, and even more preferably 14% by mass or less, of the clay granules, from the viewpoint of granule strength of the clay granules.

A pH of water dispersion of the clay granules is determined using the glass electrode method under the determination conditions of 20° C. and 2% by mass. The water dispersion of the clay granules has a pH of preferably 9.0 or more, more preferably 9.5 or more, and even more preferably 10.0 or more, from the viewpoint of the quality control.

<Component (b)>

The component (b), a nonionic surfactant, is contained in an amount of from 1.0 to 18% by mass of the softening detergent composition of the present application. The component (b) is contained in an amount of preferably from 2 to 18% by mass, more preferably from 2 to 15% by mass, even more preferably from 2.5 to 15% by mass, even further more preferably from 3 to 12% by mass, even further more preferably from 3.5 to 9% by mass, even further more preferably from 4 to 9% by mass, and especially preferably from 4 to 8% by mass, of the softening detergent composition, from the viewpoint of softening ability, detergency and the property of generating insoluble remnants on clothes.

Specific compounds for the component (b) include polyoxyalkylene alkyl (8 to 20 carbon atoms) ethers, alkyl polyglycosides, polyoxyalkylene alkyl (8 to 20 carbon atoms) phenyl ethers, polyoxyalkylene sorbitan fatty acid (8 to 22 carbon atoms) esters, polyoxyalkylene glycol fatty acid (8 to 22 carbon atoms) esters, polyoxyethylene-polyoxypropylene block polymers, and the like. Especially, a polyoxyalkylene alkyl ether in which an alkylene oxide such as ethylene oxide or propylene oxide is added to an alcohol having 10 to 18 carbon atoms is preferable. The average number of moles of the alkylene oxide added is preferably from 4 to 20, more preferably from 4 to 16, even more preferably from 4 to 12, and especially preferably from 4 to 8, from the viewpoint of improvement in softening ability. The nonionic surfactant has an HLB value of preferably from 10.5 to 15.0, and even more preferably from 11.0 to 14.5, as calculated by Griffin method.

<Component (c)>

The component (c), an anionic surfactant, provided that a salt of a fatty acid is excluded, is contained in an amount of from 6 to 27% by mass of the softening detergent composition of the present application. The component (c) is contained in an amount of preferably from 10 to 26% by mass, more preferably 12 to 25% by mass, even more preferably 16 to 25% by mass, and even more preferably from 20 to 25% by mass, of the softening detergent composition, from the viewpoint of softening ability and detergency.

Specific compounds for the component (c) include salts of sulfuric acid esters of alcohols having 10 to 18 carbon atoms, salts of sulfuric acid esters of alkoxylates of alcohols having 8 to 20 carbon atoms, alkylbenzenesulfonates, paraffinsulfonates, α-olefinsulfonates, salts of α-sulfofatty acids, salts of alkyl esters of α-sulfofatty acids, and the like. In the present invention, especially, those containing linear alkylbenzenesulfonates of which alkyl moiety has 10 to 14 carbon atoms, and more preferably 12 to 14 carbon atoms, or alkyl sulfates of which alkyl moiety has 10 to 18 carbon atoms are preferable. As the counterions, alkali metal salts and amines are preferable, and especially sodium and/or potassium, monoethanolamine and diethanolamine are preferable. In addition, a mixture system with an alkyl sulfate is more preferable, and those having a mass ratio of alkylbenzenesulfonate/alkyl sulfate of from 30/1 to 1/1 are even more preferable, and those having a mass ratio of from 5/1 to 6/5 are especially preferable. Further, a ratio of branched chain/linear chain in the alkyl moiety of the alkyl sulfate is preferably from 10/90 to 99/1, more preferably from 20/80 to 97/3, even more preferably from 30/70 to 95/5, and especially preferably from 40/60 to 90/10, from the viewpoint of softening ability.

<Component (d)>

The softening detergent composition of the present invention further contains an alkalizing agent in an amount of from 10 to 35% by mass. The component of the alkalizing agent includes (d1) carbonates, (d2) crystalline silicates, (d3) amorphous silicates, and the like. The (d1) carbonates are contained in an amount of preferably from 12 to 30% by mass, and more preferably from 15 to 25% by mass, from the viewpoint of detergency. The silicates (crystalline silicates and amorphous silicates), which are a total of the component (d2) and the component (d3), are contained in an amount of 6% by mass or less, preferably 4% by mass or less, and more preferably from 2% by mass or less, of the softening detergent composition, from the viewpoint of softening ability. Also, the silicates are contained in an amount of, as the lower limit, preferably 0.1% by mass or more, more preferably 0.3% by mass or more, and even more preferably from 0.5% by mass or more, from the viewpoint of anticorrosive property.

<Component (e)>

The softening detergent composition of the present invention contains a crystalline aluminosilicate such as zeolite as a component (e) in an amount of from 3 to 35% by mass. The component (e) includes various zeolite, preferably a zeolite having an average particle sizes of from 1 to 5 μm. The component (e) is contained in an amount of preferably from 6 to 30% by mass, and more preferably from 8 to 27% by mass, of the softening detergent composition, from the viewpoint of detergency and dispersibility of the clay granules.

In addition, the softening detergent composition of the present invention further contains a salt of a fatty acid in an amount of preferably from 0.3 to 3% by mass, more preferably from 0.4 to 2% by mass, and even more preferably from 0.5 to 1.5% by mass, from the viewpoint of softening ability.

The salt of a fatty acid includes, for example, fatty acids having 10 to 22 carbon atoms, and the like, and those having 10 to 18 carbon atoms are preferable. The counterion is preferably a salt of an alkali metal such as sodium or potassium, and especially preferably a sodium salt.

<Water>

In addition, the softening detergent composition contains water (water content in accordance with method of mass loss by heating described in JIS K 3362:1998) in an amount of preferably from 0.1 to 10% by mass, more preferably from 0.2 to 6% by mass, and even more preferably from 0.5 to 4% by mass, from the viewpoint of stability and productivity.

<Other Components>

The softening detergent composition of the present invention can contain a builder (amorphous aluminosilicate, sodium tripolyphosphate, sodium pyrophosphate, organic builder such as aminocarboxylate, hydroxyaminocarboxylate, hydroxycarboxylate, cyclocarboxylate, ether carboxylate, or organic carboxylic acid (carboxylate) polymer, or the like); an agent for preventing redeposition (polyacrylate, carboxymethyl cellulose, or the like); other softening agent; a fluorescer; a defoaming agent (soap, silicone, or the like); an enzyme (protease, cellulase, amylase, lipase, and the like); an enzyme stabilizer; a colorant; a perfume; a bleaching agent; a bleaching activator; or the like, which is known in the field of laundry detergents.

A water-soluble Na salt and a water-soluble K salt in the softening detergent composition of the present invention will be described hereinbelow.

The Na salt includes water-soluble inorganic salts such as sodium carbonate, sodium chloride, sodium sulfate, sodium bicarbonate, sodium sulfite, crystalline and amorphous sodium silicates, carbonate-hydrogen peroxide adducts, and borate-hydrogen peroxide adducts; water-soluble organic acid salts such as sodium citrate, and sodium fumarate; water-soluble polymers such as sodium polyacrylate, a sodium salt of acrylic acid-maleic acid copolymer, and carboxymethyl cellulose; and sodium salts of known surfactants, and the like.

Also, the K salt includes water-soluble inorganic salts such as potassium carbonate, and potassium sulfate; water-soluble organic acid salts such as potassium citrate, and potassium fumarate; potassium polyacrylate, a potassium salt of acrylic acid-maleic acid copolymer; and potassium salts of known surfactants, and the like.

Among the Na salts and K salts mentioned above, sodium carbonate, potassium carbonate, sodium chloride, and sodium sulfate are preferable in that Na and K are contained in large amounts, and sodium polyacrylate and a sodium salt of acrylic acid-maleic acid copolymer are especially preferable from the viewpoint of detergency. In addition, although tripolyphosphate is a useful builder from the viewpoint of exhibiting softening ability, it is preferable that tripolyphosphate is not substantially contained from the viewpoint of environmental consideration. Also, the softening detergent composition of the present invention contains the water-soluble Na salt and/or water-soluble K salt in an amount corresponding to 23% by mass or more when calculated as $Na_2O$ or $K_2O$ (in a total amount of 23% by mass or more when both the water-soluble Na salt and water-soluble K salt are contained). The water-soluble Na salt and/or water-soluble K salt is contained in an amount of preferably 24% by mass or more, more preferably 25% by mass or more, and even more preferably 26% by mass or more, of the softening detergent composition, from the viewpoint of improvement in dispersibility.

The softening detergent composition of the present invention having the compositions as described above can be produced by mixing each of the above-mentioned components by a known method. Also, the softening detergent composition may be subjected to surface modification with a surface-modifying agent, from the viewpoint of free-flowability and anti-caking property.

2. Physical Properties of Softening Detergent Composition

The softening detergent composition of the present invention is preferably in the form of powder or tablet, from the viewpoint of stability, and more preferably in the form of powder. The softening detergent composition has an average particle size of preferably from 200 to 1000 μm, more preferably from 250 to 900 μm, and even more preferably from 300 to 800 μm, as obtained from the particle size determined by a sieving method with a sieving machine described in JIS K 3362:1998, from the viewpoint of low-temperature dissolubility and stability. The softening detergent composition has a bulk density of preferably from 300 to 1200 g/L, more preferably from 400 to 1100 g/L, even more preferably from 600 to 1000 g/L, and especially preferably from 700 to 980 g/L, as determined by the method described in JIS K 3362: 1998, from the viewpoint of low-temperature dissolubility and stability.

A 0.1% by mass aqueous solution of the softening detergent composition has a pH of preferably from 8 to 12, more preferably from 9 to 11.5, even more preferably from 9.5 to 11, and especially preferably from 10 to 11, as determined by the method described in JIS K3362:1998 at 20° C., from the viewpoint of detergency, softening ability, and damaging property.

The softening detergent composition has a calcium capturing capacity of preferably from 20 to 300 $CaCO_3$ mg/g, more preferably from 50 to 200 $CaCO_3$ mg/g, and even more preferably from 100 to 150 $CaCO_3$ mg/g, as determined by the following determination method, from the viewpoint of detergency and softening ability.

(Method for Determination of Calcium Capturing Capacity)

The calcium capturing capacity (amount of calcium ions captured) is obtained in accordance with the method disclosed in JP-A-Hei 3-277696, page 3, lower right column, line 6 to page 4, upper left column, line 6, provided that the anionic surfactant should read as a softening detergent composition.

EXAMPLES

Examples 1 to 13 and Comparative Examples 1 to 2

A detergent base was obtained from components excluding clay granules, a bleaching agent, a bleaching activator, enzymes, a perfume, and 6% by mass of a zeolite for surface modification. To the detergent base were added and mixed the remaining components, to give a softening detergent composition. The compositions of the softening detergent composition are shown in Table 1.

All of the resulting softening detergent compositions had a pH of their 0.1% by mass aqueous solutions in the range of from 10 to 11, as determined by the method described in JIS K3362:1998 at 20° C., a calcium capturing capacity in the range of from 50 to 200 $CaCO_3$ mg/g, an average particle size in the range of from 300 to 800 μm, and a bulk density in the range of from 700 to 980 g/L.

TABLE 1

| | | Examples | | | | | | | |
|---|---|---|---|---|---|---|---|---|---|
| | | 1 | 2 | 3 | 4 | 5 | 6 | 7 | 8 |
| Formulation Composition of Softening Detergent Composition (% by Mass) | | | | | | | | | |
| (a) | Clay Granules (I) | | | | | | | | 10 |
| | Clay Granules (II) | | | | | 10 | | | |
| | Clay Granules (III) | 10 | 10 | 10 | 10 | | | | |
| | Clay Granules (IV) | | | | | | 10 | | |
| | Clay Granules (V) | | | | | | | | |
| | Clay Granules (VI) | | | | | | | 10 | |
| (b) | Nonionic Surfactant | 4 | 2.5 | 5 | 8 | 8 | 8 | 8 | 5 |
| (c) | LAS-Na | 16 | 19 | 12 | 12 | 12 | 12 | 12 | 9 |
| | AS-Na | 1 | | 4 | | | | | 3 |
| (d) | Sodium Carbonate | 24 | 15 | 22 | 18 | 18 | 18 | 18 | 27 |
| | Sodium Bicarbonate | 5 | | | | | | | |
| | Crystalline Silicate | 0.5 | 0.5 | | 1 | 1 | 1 | 1 | 1 |
| | No. 2 Silicate | 0.5 | 0.5 | 5 | | | | | |
| (e) | Zeolite | 27.5 | 32 | 26 | 25 | 25 | 25 | 25 | 18 |
| Others | Sodium Chloride | | | | 4 | 4 | 4 | 4 | 3 |
| | Sodium Sulfate | 4 | 15 | 4 | 11 | 11 | 11 | 11 | 13 |
| | Sodium Tripolyphosphate | | | | | | | | |
| | Sodium Sulfite | 0.5 | | 0.5 | 0.5 | 0.5 | 0.5 | 0.5 | 0.5 |
| | AA Polymer | | 1 | | 5 | 5 | 5 | 5 | 5 |

TABLE 1-continued

| | | | | | | | | |
|---|---|---|---|---|---|---|---|---|
| AA/MA Polymer | 2 | | 2 | | | | | |
| PEG | 0.5 | 0.5 | 2 | 1 | 1 | 1 | 1 | 1 |
| Soap | | | 1.5 | 1 | 1 | 1 | 1 | |
| Perfume | 0.3 | 0.3 | 0.3 | 0.3 | 0.3 | 0.3 | 0.3 | 0.3 |
| Fluorescer | 0.2 | 0.2 | 0.2 | 0.2 | 0.2 | 0.2 | 0.2 | 0.2 |
| Enzymes | 0.5 | 0.5 | 0.5 | 0.5 | 0.5 | 0.5 | 0.5 | 0.5 |
| Bleaching Agent | | | | | | | | |
| Bleaching Activator | | | | | | | | |
| Water | 3.5 | 3 | 5 | 2.5 | 2.5 | 2.5 | 2.5 | 3.5 |
| Total | 100 | 100 | 100 | 100 | 100 | 100 | 100 | 100 |
| Clay Granules | | | | | | | | |
| Na/Ca Mass Ratio | 0.33 | 0.33 | 0.33 | 0.33 | 0.17 | 0.77 | 0.68 | 0.09 |
| % by Mass of Na | 2.1 | 2.1 | 2.1 | 2.1 | 1.1 | 4.6 | 1.2 | 0.61 |
| % by Mass of Water-Soluble Na Salt and K Salt When Calculated as $Na_2O$ and $K_2O$ | 20.5 | 17.8 | 19.3 | 20.9 | 20.9 | 20.9 | 20.9 | 26.6 |
| Qualities of Softening Detergent Composition | | | | | | | | |
| Detergency | ○ | ○ | ○ | ○ | ○ | ○ | ○ | ○ |
| Softening Ability | ◎ | ◎ | ◎ | ○ | ○ | ○ | ○ | ◎ |
| Property of Generating Insoluble Remnants on Clothes | ○ | ○ | ○ | ○ | ○ | ◎ | ◎ | ○ |

| | | Examples | | | | | Comparative Examples | |
|---|---|---|---|---|---|---|---|---|
| | | 9 | 10 | 11 | 12 | 13 | 1 | 2 |
| Formulation Composition of Softening Detergent Composition (% by Mass) | | | | | | | | |
| (a) | Clay Granules (I) | | | | | | 10 | |
| | Clay Granules (II) | | | | | | | |
| | Clay Granules (III) | | 10 | | | | | |
| | Clay Granules (IV) | | | | | | | |
| | Clay Granules (V) | 10 | | 10 | 10 | 10 | | 10 |
| | Clay Granules (VI) | | | | | | | |
| (b) | Nonionic Surfactant | 5 | 5 | 10 | 3 | 1.5 | 8 | 8 |
| (c) | LAS-Na | 9 | 9 | 7 | 20 | 25 | 12 | 12 |
| | AS-Na | 3 | 3 | | | | | |
| (d) | Sodium Carbonate | 27 | 21.5 | 27 | 34 | 30 | 18 | 18 |
| | Sodium Bicarbonate | | | | | | | |
| | Crystalline Silicate | 1 | 1 | 1 | 0.5 | | 1 | 1 |
| | No. 2 Silicate | | | | | | | |
| (e) | Zeolite | 18 | 18 | 18 | 20 | 6.5 | 25 | 25 |
| Others | Sodium Chloride | 3 | 3 | 5 | | | 4 | 4 |
| | Sodium Sulfate | 13 | 13 | 11 | 6 | 5 | 11 | 11 |
| | Sodium Tripolyphosphate | | | | | 18 | | |
| | Sodium Sulfite | 0.5 | | 0.5 | 0.5 | | 0.5 | 0.5 |
| | AA Polymer | 5 | | 5 | | | 5 | 5 |
| | AA/MA Polymer | | 5 | | 0.5 | | | |
| | PEG | 1 | 1 | 1 | 1 | 0.5 | 1 | 1 |
| | Soap | | | | | | 1 | 1 |
| | Perfume | 0.3 | 0.3 | 0.3 | 0.3 | 0.3 | 0.3 | 0.3 |
| | Fluorescer | 0.2 | 0.2 | 0.2 | 0.2 | 0.2 | 0.2 | 0.2 |
| | Enzymes | 0.5 | 0.5 | 0.5 | 0.5 | 0.5 | 0.5 | 0.5 |
| | Bleaching Agent | | 5 | | | | | |
| | Bleaching Activator | | 1 | | | | | |
| | Water | 3.5 | 3.5 | 3.5 | 3.5 | 2.5 | 2.5 | 2.5 |
| Total | | 100 | 100 | 100 | 100 | 100 | 100 | 100 |
| Clay Granules | | | | | | | | |
| | Na/Ca Mass Ratio | 0.48 | 0.33 | 0.48 | 0.48 | 0.48 | 0.09 | 0.48 |
| | % by Mass of Na | 0.82 | 2.1 | 0.82 | 0.82 | 0.82 | 0.61 | 0.82 |
| % by Mass of Water-Soluble Na Salt and K Salt When Calculated as $Na_2O$ and $K_2O$ | | 26.6 | 25.2 | 26.2 | 24.8 | 29.6 | 20.9 | 20.9 |
| Qualities of Softening Detergent Composition | | | | | | | | |
| | Detergency | ○ | ○ | ○ | ○ | ○ | ○ | ○ |
| | Softening Ability | ◎ | ◎ | ○ | ◎ | ◎ | ○ | ○ |
| | Property of Generating Insoluble Remnants on Clothes | ○ | ◎ | ○ | ○ | ◎ | X | Δ |

Incidentally, the detergency, the softening ability, and the property of generating insoluble remnants on clothes of the resulting softening detergent compositions were evaluated in accordance with the following methods. The results are shown in Table 1.

(Preparation of Cloths with Sebum Dirt Stains on Collar)

The cloths with sebum dirt stains on collar described in JIS K3362:1998 were prepared.

(Washing Conditions and Evaluation Method)

The detergency of the softening detergent compositions of Table 1 was compared to that of the detergency-judging index detergent in accordance with the method for evaluating detergency for laundry synthetic detergents described in JIS K 3362:1998. Here, the used concentration of the softening detergent composition of Table 1 was 1.0 g/L.

Evaluation Criteria

○: The detergency is higher than that of the index detergent.

Δ: The detergency is of the same level as that of the index detergent.

X: The detergency is lower than that of the index detergent.

(Preparation of Towel for Evaluation)

A commercially available cotton towel (cotton 100%) was treated with a 0.5 g/L solution of a pretreatment agent mixture prepared by mixing a nonionic surfactant (ethylene oxide adduct prepared by adding ethylene oxide in an average of 6 mol to a primary alcohol having 12 carbon atoms), a crystalline silicate ("Prefeed granules") and sodium carbonate in a weight ratio of 1:1:3 using a mini-wash machine ("N-BK2" manufactured by National Panasonic). At a water temperature of 20° C., a cycle of washing for 7 minutes, a centrifugal spin-drying, a 3-minute rinsing, spin-drying, a 3-minute rinsing and spin-drying was repeated for a total of five times, and a towel from which the treatment agent was removed was used for evaluation.

(Evaluation Method for Softening Ability)

The amount 5.0 g of a softening detergent composition of Table 1 and 0.3 kg of cotton towels (4 pieces of 70 cm×30 cm) were introduced into 5 L of water at 20° C., and the towels were washed for 7 minutes. After spin-drying, the towels were subjected to a 3-minute rinsing in 5 L of water, spin-drying, a 3-minute rinsing, spin-drying, and air-drying. Sensory evaluation of the feel of softness was conducted by the five individuals using the towel washed with the softening detergent composition and the pre-treated towel as a pair for the evaluation. The case where there was no difference or where the washed towel was hardened had a score 0; the case where the washed towel was slightly softened had a score 1; the case where the washed towel was softened to some extent had a score 2; and the case where the washed towel was clearly softened had a score 3. The softening ability for a total score of five individuals was evaluated as follows.

Evaluation Criteria

◎: The total score is score 10 or higher.

○: The total score is score 6 or higher and less than score 10.

Δ: The total score is score 3 or higher and less than score 6.

X: The total score is less than score 3.

(Evaluation Method for Property of Generating Insoluble Remnants on Clothes)

The amount 5.0 g of a softening detergent composition of Table 1 and 0.3 kg of black, single cotton broadcloth 40 (19 pieces of cloths worked to a size of 30 cm×38 cm) (manufactured by K.K. Tanigashira Shoten) were introduced into 5 L of water at 5° C., and the towels were washed for 7 minutes. After spin-drying, the towels were subjected to a 3-minute rinsing in 5 L of water, spin-drying, a 3-minute rinsing, spin-drying, and air-drying. The property of generating insoluble remnants on clothes was evaluated, in accordance with the following evaluation criteria, from the number and the sizes of the insoluble remnants on front and back side per piece of the black cotton broadcloth washed with the softening detergent composition.

Evaluation Criteria

◎: The insoluble remnants are not found (hardly found).

○: There are no insoluble remnants of granules having larger sizes (0.5 mm or more), and several to a dozen granules of insoluble remnants of fine powder (less than 0.5 mm) are found.

Δ: There are no insoluble remnants of granules having larger sizes (0.5 mm or more), and a dozen or so granules of insoluble remnants of fine powder (less than 0.5 mm) are found.

X: There are some insoluble remnants of granules having larger sizes (0.5 mm or more), and insoluble remnants of fine powder (less than 0.5 mm) are also found.

XX: There are at least several insoluble remnants of granules having larger sizes (0.5 mm or more), and a large number of insoluble remnants of fine powder (less than 0.5 mm) are also found.

It can be seen from the results of Table 1 that, the components (a), (b), (c), (d), and (e), and the like are formulated in given concentrations and given ratios in Examples 1 to 13, and whereby softening detergent compositions having excellent property of generating insoluble remnants on clothes, softening ability, and detergency, as compared to Comparative Examples 1 to 2, are obtained.

Here, in Examples, the following ones were used as each component.

Zeolite: "Zeobuilder" (manufactured by Zeobuilder, median diameter: 3.0 μm);

Anionic Surfactant:

LAS-Na: a sodium linear alkylbenzenesulfonate of which alkyl moiety has 12 to 14 carbon atoms;

AS-Na: a sodium alkyl sulfate of which alkyl moiety has 12 to 16 carbon atoms;

Nonionic surfactant: an adduct prepared by adding EO in an average of 6 mol to a primary alcohol having 10 to 14 carbon atoms;

Soap: a sodium salt of a fatty acid of which alkyl moiety has 14 to 18 carbon atoms;

PEG: polyethylene glycol (weight-average molecular weight: 8,500);

Sodium carbonate: "DENSE ASH" (manufactured by Central Glass Co., Ltd.);

Sodium sulfate: anhydrous neutral sodium sulfate (manufactured by SHIKOKU CHEMICALS CORPORATION);

Sodium Chloride: "Nakuru N" (manufactured by Naikai Salt Industries Co., Ltd.)

Sodium bicarbonate: sodium bicarbonate (manufactured by Tosoh Corporation);

Sodium tripolyphosphate: sodium tripolyphosphate (manufactured by Shimonoseki Mitsui Chemicals, Inc.);

Crystalline silicate: "Prefeed granules" (manufactured by K.K. Tokuyama Siltex);

Sodium sulfite: sodium sulfite (manufactured by MITSUI CHEMICALS, INC.);

No. 2 Silicate: No. 2 sodium silicate (manufactured by FUJI CHEMICAL INDUSTRY CO., LTD.);

AA polymer: polyacrylic acid (average molecular weight: 15,000; determined by GPC, calculated as polyethylene glycol, manufactured by Kao Corporation);

AA/MA Polymer: acrylic acid-maleic acid copolymer (sodium salt (70% by mol neutralization), the monomer ratio being acrylic acid/maleic acid=3/7 (molar ratio), average molecular weight: 70,000);

Enzymes: "Cellulase K" (described in JP-A-Showa 63-264699), "Kannase 24TK" (manufactured by Novozymes), and "Savinase 6.0T" (manufactured by Novozymes), being used in a mass ratio of 3:1:2;

Fluorescer: "Tinopal CBS-X" (manufactured by Ciba Specialty Chemicals K.K.);

Bleaching Agent: a sodium carbonate-hydrogen peroxide adduct (sodium percarbonate), the bleaching agent described in Japanese Patent Laid-Open No. 2000-256699, paragraph 0019; and Bleaching Activator: sodium lauroyloxybenzenesulfonate granules (the bleaching activator described in Japanese Patent Laid-Open No. 2000-256699, paragraph 0018

As Clay Granules (I) to (VI) in Examples, the followings ones are used.

The method for producing Clay Granules (I) is as follows.

One-hundred parts by mass of a bentonite clay ore having a Na/Ca mass ratio of 0.02 and a water content of 25% by mass and 1.0 part by mass of sodium carbonate are supplied into a 2 L Henschel mixer, and the ingredients are mixed at a rotational speed of 1600 rpm for 3 minutes. The resulting mixture is granulated with an extruder-granulator (screen diameter: 2 mmϕ). Next, the resulting granules are dried with a dryer at 80° C. until the water content is reduced to 12% by mass, and the dried granules are pulverized with a mortar to a size of 125 μm-sieve-pass. One-hundred parts by mass of this pulverized product are supplied into the Henschel mixer, and 25 parts by mass of water are added thereto while mixing at a rotational speed of 1600 rpm, and the mixture is blended for 30 seconds. This mixture is dried with a dryer at 80° C. until the water content is reduced to 12% by mass, and those pulverized products that are oversized (1410 μm or more) and those that are undersized (180 μm or less) are excluded, to give Clay Granules (I). The resulting clay granules had a Na/Ca mass ratio of 0.09, and contained Na in an amount of 0.61% by mass.

The method for producing Clay Granules (II) is carried out in accordance with the method for producing Clay Granules (I), except that the amount of sodium carbonate supplied is changed to 2.0 parts by mass. The resulting clay granules had a water content of 12% by mass and a Na/Ca mass ratio of 0.17, and contained Na in an amount of 1.1% by mass.

The method for producing Clay Granules (III) is carried out in accordance with the method for producing Clay Granules (I), except that the amount of sodium carbonate supplied is changed to 4.2 parts by mass. The resulting clay granules had a water content of 12% by mass and a Na/Ca mass ratio of 0.33, and contained Na in an amount of 2.1% by mass.

The method for producing Clay Granules (IV) is carried out in accordance with the method for producing Clay Granules (I), except that the amount of sodium carbonate supplied is changed to 10.0 parts by mass. The resulting clay granules had a water content of 12% by mass and a Na/Ca mass ratio of 0.77, and contained Na in an amount of 4.6% by mass.

The method for producing Clay Granules (V) is carried out in accordance with the method for producing Clay Granules (I), except that a bentonite clay ore having a Na/Ca mass ratio of 0.33 and a water content of 25% by mass is used as a starting material and the amount of sodium carbonate supplied is changed to 0.5 parts by mass. The resulting clay granules had a water content of 12% by mass and a Na/Ca mass ratio of 0.48, and contained Na in an amount of 0.82% by mass.

The method for producing Clay Granules (VI) is carried out in accordance with the method for producing Clay Granules (V), except that the amount of sodium carbonate supplied is changed to 1.2 parts by mass. The resulting clay granules had a water content of 12% by mass and a Na/Ca mass ratio of 0.68, and contained Na in an amount of 1.2% by mass.

INDUSTRIAL APPLICABILITY

The softening detergent composition of the present invention can be suitably used in a softening detergent for fibrous manufactured articles, such as clothes, as represented by, for example, towels, bath towels, T-shirts, and sweat shirts, each made of cotton.

The invention claimed is:

1. A softening detergent composition comprising:

(a) 1 to 20% by mass of clay granules comprising as a main component a smectite clay mineral represented by the following general formula (I), provided that a Na/Ca mass ratio in the granules is less than 1.0:

$$[Si_8(Mg_aAl_b)O_{20}(OH)_4]^{X-}.X/n\ [Me]^{n+} \quad (I)$$

wherein a, b, and x satisfy the formulas $0<a\leqq 6$, $0\leqq b\leqq 4$, $0.2\leqq x=12-2a-3b\leqq 1.2$; Me is at least one member of Na, K, Li, Ca, Mg and $NH_4$; and n is valency of Me;

(b) 1.0 to 18% by mass of a nonionic surfactant;

(c) 16 to 27% by mass of an anionic surfactant, provided that a salt of a fatty acid is excluded from said 16 to 27% range;

(d) 10 to 35% by mass of an alkalizing agent, provided that a silicate is contained in an amount of 6% by mass or less of the softening detergent composition; and (e) 3 to 35% by mass of a crystalline aluminosilicate, wherein the composition further satisfies the following condition (ii) or both of conditions (i) and (ii):

(i) said clay granules contain Na in an amount of 1.0% by mass or more; and (ii) said softening detergent composition contains a water-soluble Na salt and/or a water-soluble K salt in an amount corresponding to 23% by mass or more of the softening detergent composition when calculated as $Na_2O$ or $K_2O$, wherein the total amount of 23% by mass or more is measured when both the water-soluble Na salt and a water-soluble K salt are present.

2. The softening detergent composition of claim 1, wherein the composition satisfies both of conditions (i) and (ii).

3. The softening detergent composition of claim 1, wherein the anionic surfactant (c) contains an alkylbenzenesulfonate and an alkyl sulfate, and said alkylbenzensulfonate and alkyl sulfate are in a ratio of from 5/1 to 6/5.

* * * * *